US006090766A

United States Patent [19]

Brink

[11] Patent Number: 6,090,766

[45] Date of Patent: Jul. 18, 2000

[54] STONE CLEANING AGENT AND PREPARATION THEREOF

[76] Inventor: Douglas F. Brink, 130 Tremont St., Barre, Vt. 05641

[21] Appl. No.: 09/415,492

[22] Filed: Oct. 12, 1999

[51] Int. Cl.[7] ..... C11D 7/08; C11D 7/10; B08B 7/00

[52] U.S. Cl. ..... 510/240; 510/108; 510/405; 510/505; 134/3; 252/79.3; 252/79.4

[58] Field of Search ..... 510/240, 108, 510/405, 505; 134/3; 252/79.3, 79.4

[56] References Cited

U.S. PATENT DOCUMENTS

| | | | |
|---|---|---|---|
| 1,574,406 | 2/1926 | Nelson | 510/240 |
| 1,574,407 | 2/1926 | Nelson | 510/240 |
| 2,278,257 | 3/1942 | Gallagher | 216/98 |
| 2,558,013 | 6/1951 | Staubly et al. | 510/281 |
| 2,714,094 | 7/1955 | McNally | 510/238 |
| 3,150,007 | 9/1964 | Kovachy | 134/4 |
| 3,481,879 | 12/1969 | Salomone et al. | 510/240 |
| 3,650,969 | 3/1972 | Baltakmens et al. | 510/204 |
| 4,738,876 | 4/1988 | George et al. | 427/299 |
| 4,775,552 | 10/1988 | Russo et al. | 427/110 |
| 4,897,213 | 1/1990 | Brink | 510/240 |
| 5,320,709 | 6/1994 | Bowden et al. | 156/667 |

FOREIGN PATENT DOCUMENTS 3637711 5/1988 Germany .

*Primary Examiner*—Lorna M. Douyon
*Attorney, Agent, or Firm*—Thomas N. Neiman

[57] ABSTRACT

It has long been the practice to clean monuments and memorials, in fact, any stone surface through the use of harsh chemicals or physical removal systems, such as sand blasting. A compound containing ammonium fluoride (NH4F), ammonium bifluoride (NH4F.HF), denatured alcohol (CH2H60) and water is mixed in an aqueous solution for use as a cleaning agent for all stone products and structures. A method of cleaning the stone items is also disclosed.

8 Claims, No Drawings

STONE CLEANING AGENT AND PREPARATION THEREOF

BACKGROUND OF THE INVENTION

This invention pertains to cleaning agents and, in particular, to such cleaning agents for use in removing weathering, micro-organisms and dirt from all stone structures and products.

The most common approaches that currently exist in the cleaning of stone monuments, memorials buildings and other stone items are the use of physical cleaning devices, such as sandblasting units, and the use of strong acids, such as muriatic acid and high water pressure devices (minimum of 100 pounds per square inch required). The stone being cleaned can be granite, slate, marble or similar stone. All these approaches have problems associated with their use. Sandblasting equipment and high pressure devices are expensive and, therefor, not economical for small stone cleaning. Additionally, the use of this technique can harm nearby shrubs and grass and the user must exercise caution to avoid those difficulties. The use of straight acidic cleaners can be harmful to the hands and the face of the user and can kill nearby shrubbery and grasses and, at the same time, can discolor the stone being cleaned. What is needed is a cleaning agent that is economical to use. Additionally, what is needed is a cleaning agent that is effective and is not harmful to the user or the environment when used as directed. Clearly, it is desirable for a cleaning agent that does not contain the limitations described above and at the same time is simple and practical to operate. It is the object of this invention to set forth an improved cleaning agent which avoids the disadvantages and limitations, recited above in current cleaning agents. The mixture disclosed in U.S. Pat. No. 4,897,213 is a cleaning agent that meets these requirements. However, what is needed is an improved mixture which works in an improved fashion.

SUMMARY OF THE INVENTION

Particularly, it is the object of this invention to teach a cleaning agent, for use in removing weathering, micro-organisms and dirt from stone monuments, memorials, buildings and other stone products consisting of a mixture of fluoride, bifluoride and alcohol; an approximated proportion of 0.42% fluoride; an approximate proportion of 7.99% bifluoride; an approximate proportion of 16.82% alcohol; and the balance an approximate proportion of 74.77% water to complete the solution.

It is also the object of this invention to teach a cleaning agent, for use in removing weathering, micro-organism, and dirt from stone monuments, memorials, buildings or other stone products, consisting in combination a mixture of ammonium fluoride, ammonium bifluoride and denatured alcohol, an approximate proportion of 0.42% ammonium fluoride, an approximate proportion of 7.99% ammonium bifluoride, an approximate proportion of 16.82% denatured alcohol, and the balance an approximate proportion of 74.77% water to complete the solution.

Finally, it is the object of this invention to teach a method of cleaning stone monuments, memorials, buildings and other stone products, consisting of the steps of placing 0.04 pounds of ammonium fluoride in a container; placing 0.71 pounds of ammonium bifluoride in a container; adding 5.00 pounds of hot water to said granular ammonium fluoride and ammonium bifluoride to form a solution; adding 1.50 pounds of denatured alcohol; mixing the above-identified mixture with sufficient hot water to form a solution of one gallon; coating the article to be cleaned with said solution by means of a brush or like means; allowing the mixture to be in contact with said article for a period of time; and rinsing said solution with plain water under a minimum amount of pressure.

DETAILED DESCRIPTION OF THE PREFERRED EMBODIMENT

Further objects and features of this invention will become more apparent by reference to the following description. The following example represents the preferred embodiment of the invention. The parts and percentage figures are expressed on a weight basis throughout the specification. The cleaning agent was prepared as follows:

| | |
|---|---|
| Ammonium Fluoride: | 0.42% |
| Ammonium Bifluoride: | 7.99% |
| Denatured Alcohol: | 16.82% |
| Water: | 74.77% |

Ammonium fluoride has a molecular weight of 37.04 and ammonium bifluoride has a molecular weight of 57.04. Both of them are orthorhombic crystals and are freely soluble in water. They are both acidic and have been used for cleaning and purifying purposes. The user would place 0.04 pounds of the ammonium fluoride; 0.71 pounds of ammonium bifluoride in a pail or like vessel. The user will then add 5.00 pounds of hot water (minimum of 120 degrees Fahrenheit) to form a solution. The user will then add 1.50 pounds of denatured alcohol and then 1.42 pounds of hot water to complete the gallon solution. The weight of the completed solution will be approximately 8.92 pounds per gallon of solution.

In operation, the user would mix the solution and then coat the item being cleaned with the solution. This is usually done with a brush. The solution is left on the item to be cleaned for a period of time. It is not necessary to leave the solution on the item for a long period of time. The solution is then rinsed off the item. An ethyl alcohol may be substituted for the denatured alcohol in similar proportions. The purpose of the alcohol is to raise the pH of the solution and the buffering of the solution will result in making it environmentally safe for humans and vegetation and, at the same time, not inhibit the cleaning effectiveness of the ammonium fluoride and the ammonium bifluoride.

While I have described my invention in connection with specific embodiments thereof, it is clearly to be understood that this is done only by way of example and not as a limitation to the scope of my invention as set forth in the objects thereof and in the appended claims.

I claim:

1. A cleaning agent, for use in removing weathering, micro-organisms and dirt from stone monuments, memorials, buildings and other stone products consisting of:

a mixture of fluoride, bifluoride and alcohol;

an approximate proportion of 0.42% fluoride;

an approximate proportion of 7.99% bifluoride;

an approximate proportion of 16.82% alcohol; and the balance an approximate proportion of 74.77% water to complete the solution.

2. A cleaning agent, according to claim 1, wherein:

said fluoride is ammonium fluoride.

3. A cleaning agent, according to claim 1, wherein:

said bifluoride is ammonium bifluoride.

4. A cleaning agent, according to claim 1, wherein:

said alcohol is a denatured or similar alcohol.

5. A cleaning agent, according to claim 1, wherein:

said balance of water is water heated to a minimum of approximately 120 degrees Fahrenheit.

6. A cleaning agent, for use in removing weathering, micro-organisms and dirt from stone monuments, memorials buildings or other stone products, consisting in combination;

a mixture of ammonium fluoride, ammonium bifluoride and denatured alcohol, an approximate proportion of 0.42% ammonium fluoride, an approximate proportion of 7.99% ammonium bifluoride, an approximate proportion of 16.82% denatured alcohol, and the balance an approximate proportion of 74.77% water to complete the solution.

7. A method of cleaning stone monuments, memorials, buildings and other stone products, consisting of the steps of:

placing 0.04 pounds of ammonium fluoride in a container;

placing 0.71 pounds of ammonium bifluoride in a container;

adding an amount of 5.00 pounds hot water to said granular ammonium fluoride and ammonium bifluoride to form a solution;

adding an amount of 1.50 pounds of denatured or similar alcohol to said solution;

mixing the above-identified mixture with sufficient hot water to form a solution of one gallon;

coating the article to be cleaned with said solution by means of a brush or like means;

allowing said mixture to be in contact with said article for a period of time; and rinsing said solution with plain water under a minimum amount of pressure.

8. A method of cleaning stone monuments, memorials, buildings and other stone products, according to claim 7, wherein:

said hot water is water having a temperature of at least 120 degrees Fahrenheit.

* * * * *